United States Patent [19]

Dünki et al.

[11] Patent Number: 4,785,146

[45] Date of Patent: Nov. 15, 1988

[54] ELECTRIC SAFETY SWITCH WITH TILTABLE CONTACT

[76] Inventors: Wilfried Dünki, Dorfstrasse 381, CH-5512 Büblikon; Werner Saxer, Othmarsingerstrasse 263, CH-5604 Hendschiken, both of Switzerland

[21] Appl. No.: 64,818

[22] Filed: Jun. 19, 1987

[30] Foreign Application Priority Data

Jun. 20, 1986 [CH] Switzerland ..... 2499/86

[51] Int. Cl.[4] ..... H01H 21/24

[52] U.S. Cl. ..... 200/250; 200/6 A; 200/339

[58] Field of Search ..... 200/339, 250, 244, 6 A, 200/335, 302.3, 276

[56] References Cited

U.S. PATENT DOCUMENTS

| | | | |
|---|---|---|---|
| 1,763,746 | 11/1929 | McShane | 200/6 A |
| 2,466,402 | 5/1949 | Falk | 200/339 |
| 2,626,999 | 1/1953 | Johnson | 200/6 A |
| 2,793,259 | 5/1957 | Parsons | 200/6 A |
| 4,001,534 | 1/1977 | Temple | 200/276 |
| 4,315,113 | 2/1982 | Fisher et al. | 200/6 A |
| 4,370,528 | 1/1983 | Aschenbach | 200/302.3 |
| 4,639,668 | 1/1987 | Petit et al. | 200/6 A |

*Primary Examiner*—Renee S. Luebke

*Attorney, Agent, or Firm*—Peter K. Kontler

[57] ABSTRACT

An electric switch wherein a fixed contact is engaged by a tiltable and reciprocable second contact under the action of an elastic washer or a coil spring. The second contact can be tilted by a projection, which extends from the housing, in cooperation with a flat abutment in the housing. When the projection is tilted, it causes the second contact to pivot relative to the abutment and to become disengaged from the fixed contact. The projection can be tilted by a bar or a tube which must be displaced by a person or object tending to penetrate into a danger zone, such as the nip of two cylinders in a printing machine or a machine tool. A third contact can be provided to be engaged by the second contact when the latter is disengaged from the fixed contact.

17 Claims, 2 Drawing Sheets

Fig. 1
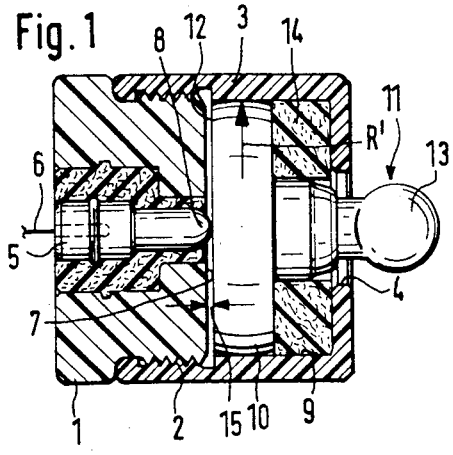
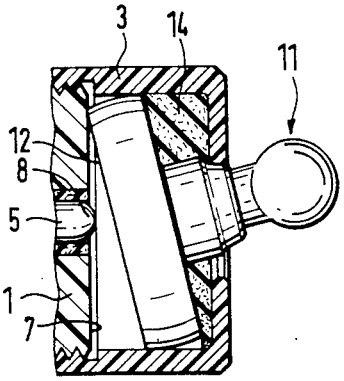
Fig. 2
Fig. 3
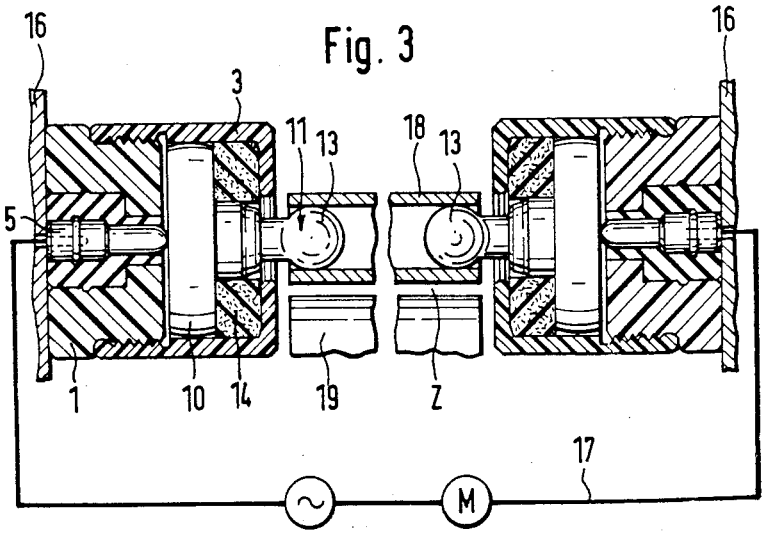

ELECTRIC SAFETY SWITCH WITH TILTABLE CONTACT

BACKGROUND OF THE INVENTION

The invention relates to improvements in electric switches, and more particularly to improvements in mechanical switches of the type wherein a first contact is normally engaged by a second contact under the action of one or more springs.

Mechanical switches can be provided with pushbuttons, pivotable levers or rotary members for moving a movable contact into or from engagement with a fixed contact. A drawback of conventional switches is that the application of a force which is required to change the position of the movable contact with reference to the associated fixed contact must always take place in a predetermined direction (particularly along a straight or along an arcuate path). Moreover, many conventional switches are designed in such a way that, if the spring which is used to bias the movable contact happens to break, its fragments are likely to establish an electrical connection at a time when such connection is not only undesirable but can cause injury or damage.

OBJECTS AND SUMMARY OF THE INVENTION

An object of the invention is to provide a novel and improved electric switch which is constructed and assembled in such a way that the position of a movable contact with reference to one or more associated contacts can be changed by moving the movable contact in any one of a number of different directions.

Another object of the invention is to provide a novel and improved safety switch which can be used in machines to reduce the likelihood of injury and/or damage.

A further object of the invention is to provide a novel and improved movable contact and a novel and improved mechanism for moving the movable contact in a switch of the above outlined character.

An additional object of the invention is to provide the switch with novel and improved means for guiding and confining the movable contact to movements in a number of different directions.

Still another object of the invention is to provide a safety device which embodies the above outlined switch.

A further object of the invention is to provide a switch which can be used in conjunction with one or more additional switches as a device for enhancing the safety of printing and/or other machines.

Another object of the invention is to provide a novel and improved method of actuating a mechanical switch wherein a mobile contact can be moved into and from engagement with one or more additional contacts.

An additional object of the invention is to provide a relatively simple, compact and inexpensive switch which can be used as a superior substitute for many conventional switches in existing machines or for other purposes.

The invention is embodied in an electric switch which comprises an insulating housing, a first contact which is provided in the housing, a second contact which is tiltably mounted in the housing, biasing means (such as an elastic washer or a coil spring) provided in the housing and serving to urge the second contact against the first contact, and means for disengaging the second contact from the first contact against the opposition of the biasing means. The disengaging means includes an abutment which is provided in and can constitute an integral part of the housing, and means for tilting the second contact with reference to the abutment in any one of a plurality of different directions against the opposition of the biasing means to thereby disengage the second contact from the first contact. The tilting means of the disengaging means is accessible externally of the housing. The housing can comprise guide means (such as a cylindrical internal surface) which defines for the second contact a predetermined path along which the second contact is reciprocable with reference to the abutment under or against the action of the biasing means into and from engagement with the first contact. Thus, the second contact can be disengaged from the first contact by tilting it with reference to the abutment and/or by exerting upon the second contact a force which entails a substantially translatory movement of the second contact away from the first contact. The two movements can be combined, i.e., the second contact can be tilted while it performs a translatory movement.

The abutment can include a flat or substantially flat surface which at least partially surrounds the first contact, and the second contact can have a side which faces the flat surface of the abutment and is in actual engagement with the abutment, at least in response to tilting of the second contact. The aforementioned side of the second contact can include an annular region or zone which substantially concentrically surrounds the first contact, and a portion of the annular zone defines with the adjacent portion of the flat surface of the abutment a fulcrum for the second contact in response to tilting of the second contact with reference to the abutment.

The second contact can comprise a substantially disc-shaped or wheel-shaped member which is adjacent the abutment, and the tilting means can comprise a projection which is substantially coaxial with the disc-shaped member and extends from the latter in a direction away from the first contact. The disc-shaped member can have a convex peripheral surface which is adjacent the cylindrical internal surface (guide means) of the housing. The radius of curvature of the convex surface equals or approximates the diameter of the internal surface of the housing; this enables the disc-shaped member of the second contact to move back and forth along the internal surface as well as to be tilted with reference to the housing.

The tilting means can constitute a conductor which is electrically connected to (e.g., integral with) the disc-shaped member of the second contact. Alternatively, the switch can comprise electric conductor means (such as a spring biased metallic pin or stud) which is electrically connected with the second contact in each position of the second contact with reference to the first contact. Such conductor means will be used if it is undesirable or dangerous to use a tilting means which is a conductor.

The switch can further comprise a third conductor which is installed in the housing in such position that it is engageable by the second contact in at least one tilted position of the second contact and preferably while the second contact is already disengaged or is still disengaged from the first contact.

The switch can further comprise means (such as an elongated bar, strip, rod or tube) for actuating the tilting means. Such actuating means can include or constitute a displaceable barrier having a portion (such as one end portion of a tube or a bar) which is operatively (preferably articulately) connected with the tilting means (e.g., by a universal joint) and extends across the entrance or inlet to a danger zone (e.g., in a machine tool or in another machine, such as a printing machine) which is accessible in response to displacement of the barrier such as is necessary in order to cause the tilting means to disengage the second contact from the first contact. The tilting means can include a bearing for the aforementioned portion of the barrier (this bearing can form part of or can constitute the aforementioned universal joint). The barrier can further comprise a second portion which is remote from the first named portion (the second portion can constitute the other end portion of a tube or bar), and such switch can further comprise a second bearing for the second portion of the barrier. In accordance with a presently preferred embodiment, the switch further comprises a second housing, additional first and second contacts in the second housing and additional tilting means for the additional second contact. The additional tilting means includes the second bearing so that the barrier can actuate the tilting means in the one and/or in the other housing. Such switch actually constitutes two switches which are preferably connected in series so that, if one thereof is open, the circuit of a machine or the like is interrupted so as to render the danger zone harmless. For example, the danger zone can be constituted by a region adjacent the nip of two printing rollers or cylinders in a printing machine, and access to such nip by the finger or hand of a careless attendant is blocked by the aforementioned barrier. When the barrier causes the one or the other switch to open, the motor which drives the rollers or cylinders is brought to a standstill.

The housing can be provided with an opening through which the tilting means for the second contact extends with sufficient freedom of swiveling or analogous movement to allow for disengagement of the second contact from the first contact by hand, by the aforementioned barrier or in any other suitable way (e.g., by an electromagnet or bowden wire).

The improved switch can be designed in such a way that the second contact is caused to bear against the abutment while engaging the first contact or that the second contact is disengaged from the abutment when it is acted upon solely by the biasing means.

The novel features which are considered as characteristic of the invention are set forth in particular in the appended claims. The improved switch itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWINGS

FIG. 1 is a central sectional view of an electric switch which embodies one form of the invention, the second contact being shown in the position of engagement with the first contact;

FIG. 2 is a fragmentary central sectional view of the switch, showing the second contact in tilted position and out of engagement with the first contact;

FIG. 3 shows two mirror symmetrical switches of the type shown in FIG. 1 and actuating means for their tilting means, the actuating means constituting a barrier which interferes with access to a danger zone in the nip of two rotary cylindrical or similar members in a machine;

DESCRIPTION OF THE PREFERRED EMBODIMENTS

Figure 4:
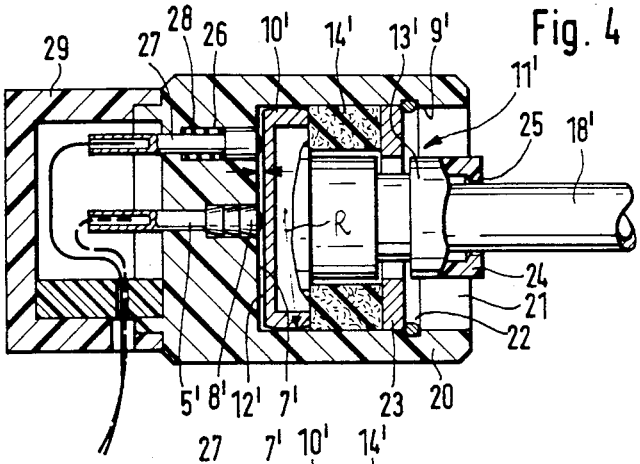
FIG. 4 is a central sectional view of a modified switch with the second contact in the position of engagement with the first contact, the tilting means for the second contact being actuatable by a modified barrier.

FIG. 1 shows a mechanical switch having a housing including a cylindrical plug 1 consisting of an insulating material and having external threads 2 in mesh with the internal threads of a cylindrical cap 3 made of an insulating material and having an end wall with a central circular opening 4. The housing 1–3 carries a fixedly installed first contact 5 having a spherical tip 8 extending slightly beyond a flat surface 7 which forms part of an abutment for a tiltable and reciprocable second contact 11 of the switch. The abutment can be said to include the externally threaded portion of the plug 1. The exposed rear end of the first contact 5 is connected with a conductor 6. The cylindrical cap 3 of the housing has a cylindrical internal surface 9, and the second contact 11 includes a disc-shaped member 10 with a convex peripheral surface having a radius of curvature R which equals or approximates the diameter of the surface 9. This enables the member 10 of the contact 11 to be reciprocable guided by the internal surface 9 for movement toward or away from the contact 5 and surface 7 as well as to be tilted by a tilting means including a projection 13 having a substantially spherical head and extending with lateral play outwardly through the opening 4 in a direction away from the contact 5. The member 10 is preferably received in the cap 3 of the housing with a small amount of radial play and this member is permanently biased toward engagement with the tip 8 of the contact 5 by an elastic washer 14 which is interposed between the apertured end wall of the cap 3 and the member 10. The washer 14 can consist of sponge rubber or another suitable elastically deformable material and is designed to normally maintain the central portion of the left-hand side of the disc-shaped member 10 in engagement with the tip 8 of the contact 5 while keeping the left-hand side of the member 10 out of contact with the flat surface 7. FIG. 1 shows a narrow annular clearance or gap 15 which normally exists between the disc-shaped member 10 and the surface 7 when the switch completes a circuit by way of the conductor 6, contact 5 and contact 11. The head of the tilting means or projection 13 is connected with another conductor, not specifically shown, for example, a tubular barrier 18 which is shown in FIG. 3. The abutment (including the surface 7) and the projection 13 together constitute a means for disengaging the contact 11 from the contact 5, either by hand or automatically. Such disengagement takes place against the opposition of the elastic washer 14 which continuously urges the central portion of the member 10 against the tip 8 of the contact 5. When the projection 13 is caused to tilt the contact 11 with reference to the housing 1–3 in any one of a practically infinite number of directions, a portion of the ring-shaped marginal zone or region 12 of the left-hand side of the member 10 comes into actual contact with the adjacent portion of the surface 7 to bring about a deformation of the elastic washer 14 and to move the central portion of the member 10 away from the tip 8 of the contact 5. This is shown in FIG. 2. The annular zone 12 concentrically surrounds the contact 5 when the switch is closed in a manner as shown in FIG. 1, i.e., when the second contact 11 is acted upon solely by the washer 14. FIG. 2 shows that the diameter of the opening 4 suffices to allow for a rather pronounced swiveling of the projection 13, i.e., for a pronounced tilting of the disc-shaped member 10 relative to the surface 7; a portion of the ring-shaped marginal zone 12 and the adjacent portion of the surface 7 of the abutment for the contact 11 then form a fulcrum for the contact 11. The washer 14 is preferably installed in prestressed condition so that it can bias the disc-shaped member 10 to the position which is shown in FIG. 1 and that it rapidly returns the member 10 to such position as soon as the application of a force which is required to tilt the contact 11 by way of the projection 13 is terminated. The contact 11 can be disengaged from the contact 5 by pulling the projection 13 in a direction to the right so as to cause the washer 14 to store additional energy while the left-hand side of the member 10 moves away from the tip 8 of the contact 5. The initial bias of the washer 14 can be varied by rotating the cap 3 relative to the plug 1 of the housing and/or vice versa. The width of the gap 15 need not exceed a fraction (e.g., one or more tenths) of one millimeter.

If desired, the contact 5 can be axially movably installed in the plug 1 to thus enable an operator to alter the extent to which the tip 8 projects beyond the surface 7 of the abutment for the contact 11. This renders it possible to select the extent of tilting which is necessary to disengage the contact 11 from the contact 5. The arrangement may be such that the disc-shaped member 10 actually abuts the surface 7 while engaging the tip 8 of the contact 5. Axial movability of the contact 5 is but one of several possible modes of selecting the sensitivity of the switch. Another possibility exists in changing the length of that portion of the projection 13 which extends beyond the opening 4 of the housing 1–3, and a further possibility is that of increasing or reducing the diameter of the disc-shaped member 10 and of altering the diameter of the internal surface 9 accordingly. The above expedients render it possible to select any one of a wide range of sensitivities, depending upon the intended use of the improved switch.

FIG. 3 shows a composite switch which includes two mirror symmetrical switches of the type shown in FIG. 1. The spherical heads of the two projections 13 constitute bearings for the respective end portions of the aforementioned tubular barrier 18 which can be said to constitute a means for actuating the projections 13, i.e., for indirectly disengaging the corresponding second contacts 11 from the associated first contacts 5. The barrier 18 is a conductor and it cooperates with the two pairs of contacts 5, 11 to normally complete an electric circuit 17 which includes an energy source and a motor M serving to drive at least one of two cylinders or other rotary bodies 19 (one shown in FIG. 3). The cylinders 19 define a nip which can be said to constitute a danger zone Z, and access to such danger zone is obstructed by the barrier 18 so that a careless operator must change the position of the barrier 18 in order to insert her or his finger or hand into the nip. Such shifting of the barrier 18 entails a tilting of the one or the other projection 13 and the resulting opening of the corresponding switch so that the circuit 17 is opened and the motor M immediately ceases to rotate the cylinders 19. The cylinders 19 can constitute printing cylinders in a printing machine but the structure which is shown in FIG. 3 can be used with equal or similar advantage in a number of other machines including a wide variety of machine tools and the like. Furthermore, it is not necessary that the safety device comprise two switches; it suffices to use the left-hand or right-hand switch of FIG. 3 and to pivotably connect the free end portion of the barrier 18 in the circuit 17. The position of the barrier 18 with reference to the cylinders 19 can be altered to even further reduce the likelihood of unauthorized penetration of a foreign object (such as a hand or a finger) into the danger zone Z. When the safety device of FIG. 3 is operative to complete the circuit 17 between the two contacts 5, the axis of the barrier 18 is or can be parallel to the axes of the cylinders 19. The initial stressing of the washers 14 in the two switches must suffice to ensure that the weight of the barrier 18 cannot cause a tilting of the one and/or other projection 13 to an extent which is necessary to disengage the respective contact 11 from the associated contact 5. In other words, the initial bias of the washers 14 should suffice to ensure that the surfaces 7 of the plugs 1 of the housings of both switches of FIG. 3 will be normally kept out of contact with the adjacent sides of the respective disc-shaped members 10. The end portions of the tubular barrier 18 define with the spherical heads of the respective projections 13 two universal joints which enable the respective contacts 11 to be tilted in any one of a practically infinite number of directions in order to become disengaged from the associated contacts 5. A change in the position of the barrier 18 can entail an opening of the one or the other switch or both switches, either simultaneously or sequentially. For example, if an object is forced toward the danger zone Z close to the right-hand end of the barrier 18, the latter is likely to first open the right-hand switch. If the foreign object is pushed toward the zone Z in a region substantially midway between the end portions of the barrier 18, the latter is likely to simultaneously open both switches which are connected in series so that opening of at least one of the switches suffices to immediately open the circuit 17. It is immaterial whether or not the initial bias of one of the washers 14 exceeds the bias of the other washer. If one of the washers 14 offers a greater resistance to deformation than the other washer, the switch which embodies the more readily deformable washer 14 will normally open ahead of the other switch. It has been found that the structure which is shown in FIG. 3 can bring about a practically instantaneous opening of the circuit 17 and hence a practically instantaneous stoppage of the motor M in such circuit to bring about immediate stoppage of the cylinders 19 and to thus reduce or eliminate the danger of injury to a careless operator and/or damage to the parts of the machine which embodies the safety device of FIG. 3.

An important advantage of the improved switch is that the contact 11 can be disengaged from the contact 5 by moving it in any of a practically infinite number or different directions including a movement along the guide means which includes the internal surface 9 of the cap 3 as well as a tilting of the contact 11 by the projection 13 and barrier 18 in any one of a large or infinite number of directions. For example, the spherical head of the projection 13 can be moved toward or away from the observer of FIG. 1, up or down as well as at any other angle with reference to the plane of FIG. 1. This enhances the versatility of the switch and its utility as a part of a safety device, e.g., the device which is shown in FIG. 3.

Another important advantage of the improved switch is that its sensitivity can be selected practically at will, e.g., by the simple expedient of selecting the extent to which the tip 8 of the contact 5 projects beyond the surface 7, by selecting the width of the gap 15 when the contact 11 is acted upon solely by the washer 14, by selecting the initial bias of the washer 14 and/or by selecting the length of the exposed part of the projection 13 and/or the locus where the barrier 18 is acted upon to open the one and/or the other switch.

Figure 5:
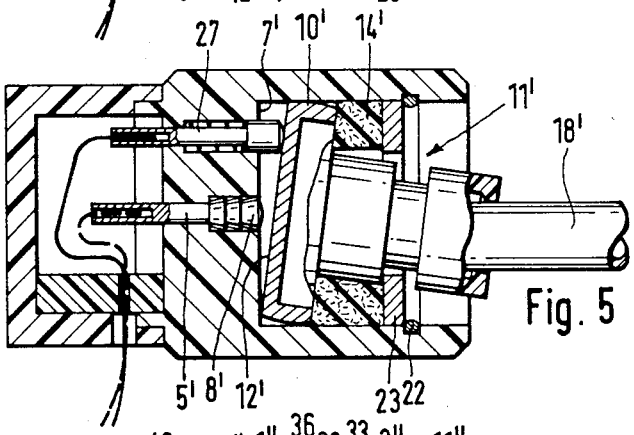
FIG. 5 illustrates the structure of FIG. 4 but with the second contact in tilted position and out of engagement with the first contact.

FIGS. 4 and 5 show a modified switch wherein the housing for a first contact 5' and a second contact 11' includes a protective hood 29 for the exposed end portion of the contact 5' and for a reciprocable conductor 27 which is biased by a coil spring 26 and is thereby maintained in permanent contact with the adjacent side of a disc-shaped member 10' forming part of the contact 11'. The main part 20 of the insulating housing is formed with a blind hole or bore 21 bounded by a cylindrical internal surface 9'. The surface 9' is formed with a circumferentially complete groove for a split ring 22 serving to retain in the bore or hole 21 an apertured end wall 23 which serves as a stop for an elastic washer 14' constituting a means for urging the member 10' of the tiltable and reciprocable contact 11' toward engagement with the tip 8' of the contact 5' and in a direction toward the flat surface 7' of the abutment of the means for disengaging the contact 11' from the contact 5'. The disengaging means further comprises an insulating projection 13' which is connected with the conductive member 10'. A portion of the annular marginal zone 12' of the left-hand side of the member 10' will come into actual abutment with the surface 7' in response to tilting of the contact 11' by way of the projection 13' which extends outwardly through a central opening of the end wall 23 and defines a bearing 24 for one end portion of a rod- or bar-shaped barrier 18' corresponding to the tubular barrier 18 of FIG. 3.

It is not necessary that the entire member 10' be made of a conductive material, i.e., it suffices to coat with conductive material that side of the member 10' which faces the surface 7' and normally engages the tip 8' of the contact 5'. Such coat is in continuous contact with the conductor 27 which is biased by the coil spring 26 in a direction to the right, as seen in FIG. 4 or 5. The peripheral surface of the member 10' is convex and its radius of curvature R preferably equals or approximates the diameter of the internal surface 9'; this enables the contact 11' to move back and forth toward or away from the tip 8' of the contact 5' as well as to be tilted whereby a portion of the marginal zone 12' engages the adjacent portion of the surface 7' to lift the central portion of the member 10' off the tip 8' of the contact 5'. The washer 14' can bear upon the adjacent end face of the cupped member 10' and/or upon the adjacent shoulder of the projection 13'. The bearing 24 of the projection 13' has an inwardly extending collar 25 which is in contact with the respective end portion of the barrier 18' and can transmit tilting forces which are needed to open the switch by disengaging the central portion of the member 10' from the tip 8' of the contact 5'. The collar 25 is preferably provided with a convex surface which contacts the end portion of the part 18'. The latter can tilt the projection 13' in any one of an infinite number of different directions and through different angles in order to disengage the contact 11' from the contact 5' when the need arises, e.g., if a foreign object is being advanced toward a danger zone which is guarded by the barrier 18'. The bias of the washer 14' (whose material can but need not be identical with that of the washer 14 shown in FIG. 1) should suffice to oppose the weight of the barrier 18' and to return the member 10' to the position of FIG. 4 (in which the marginal portion 12' of the left-hand side of the member 10' is out of contact with the surface 7') as soon as the application of tilting forces to the barrier 18' is terminated or as soon as such forces are reduced to the extent which enables the washer 14' to move the member 10' from the tilted position of FIG. 5 to the normal position of FIG. 4. If desired, the washer 14' can be replaced by or used jointly with one or more coil springs.

The extent to which the tip 8' of the contact 5' projects beyond the surface 7' can be regulated in order to alter the sensitivity of the switch. The bias of the prestressed coil spring 26 suffices to ensure that the tip of the conductor 27 remains in conductive engagement with the member 10' irrespective of the inclination of this member with reference to the surface 7' of the abutment for the contact 11'. The hood 29 is preferably detachable to afford access to the outer end of the contact 5' and to the conductor 27. For example, the hood 29 can be threadedly connected to or is simply slipped onto and is frictionally held on the main portion 20 of the housing.

The switch of FIGS. 4 and 5 can be modified in a number of ways. For example, the reciprocable conductor 27 can be replaced with a stationary conductor which is installed in an annular groove of the surface 7' and is in continuous contact with one end convolution of a conductive coil spring the other end convolution of which bears against the adjacent side of the member 10'. The initial stressing of such spring (which can be made of beryllium bronze) is such that one end convolution of the spring is in permanent contact with the conductor in the aforementioned groove of the surface 7' and the other end convolution of the spring is in continuous contact with the adjacent side of the member 10'. The initial bias of the just discussed spring between the surface 7' and the member 10' must not exceed the initial bias of the washer 14' or of another biasing device which is used in lieu of the washer.

The switch of FIGS. 4 and 5 will be used when it is not desirable, practical or possible to use a conductive part 18', i.e., when the projection 13' should constitute an insulator so that the conductive portion (member 10') of the contact 11' must be connected into an electric circuit in a different way.

Figure 6:
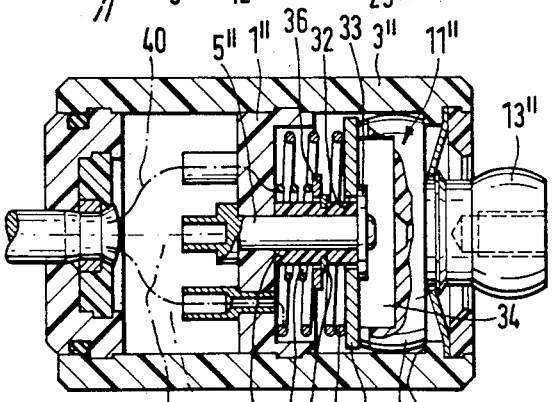
FIG. 6 is a central sectional view of a third switch wherein the second contact can engage a third contact in response to its tilting to a position of disengagement from the first contact.

FIG. 6 shows a further switch wherein the housing 1'', 3'', for a fixed first contact 5'' and a tiltable and reciprocable second contact 11'' defines an internal shoulder or surface 7'' forming part of the abutment for the non-conductive cupped portion 29 of the contact 11''. The means for disengaging the contact 11'' from the contact 5'' further comprises a tilting means in the form of a projection 13'' which is integral with the non-conductive portion 29 and extends outwardly beyond the shoulder 7'' so that it is accessible at the exterior of the housing including the parts 1'' and 3''. The contact 11″ further comprises a disc-shaped member 30 of conductive material which is biased by a coil spring 31 constituting an equivalent of the conductor 27 of FIGS. 4 and 5. The coil spring 31 urges the member 30 against a washer-like metallic element 33 of the contact 5″ and also urges the insulating portion 29 of the contact 11″ against the shoulder 7″, i.e., this shoulder is in actual contact with the portion 29 when the switch including the contacts 5″ and 11″ is closed. The portion 29 resembles a disc with a convex peripheral surface whose radius of curvature equals or approximates the diameter of the internal surface of the housing portion 3″ so that the contact 11″ can be reciprocated along the guide means which is constituted by the internal surface of the portion 3″ and that the contact 11″ can be tilted by the projection 13″ in cooperation with the shoulder 7″ of the abutment for the contact 11″. The conductive disc 30 of the contact 11″ has a central opening 32 for the insulating shank 35 of the contact 5″. The washer-like conductive element 33 of this contact is installed in a recess 34 in the adjacent side of the insulating portion 29 forming part of the contact 11″. The element 33 is connected with a conductor 39 by a metallic core of the contact 5″. A conductor 41 in the housing is connected with the coil spring (conductor) 31 which biases the contact 11″ against the shoulder 7″, and a further conductor 40 is connected with a conductor in the form of a coil spring 37 serving to bias a third contact 36 against a stop 38 (e.g., a split ring) on the insulating shank 35 of the contact 5″. The arrangement is such that, when the coil spring 31 is free to maintain the insulating portion 29 of the contact 11″ in engagement with the shoulder 7″, the switch including the contacts 5″ and 11″ is closed because the member 30 bears against the element 33. Thus, the circuit including the conductors 39 and 40 is completed. However, when the contact 11″ is tilted by the projection 13″ in cooperation with the shoulder 7″, the member 30 is disengaged from the element 33 (i.e., the contact 11″ is disengaged from the contact 5″) but the member 30 engages the contact 36 so that the switch closes the circuit which includes the conductors 39 and 41.

The diameter of the element 33 exceeds the diameter of the opening 32 in the member 30 of the contact 11″.

The member 30 of the contact 11″ can be caused to engage or to be disengaged from the third contact 36 in response to tilting and/or translatory movement of the contact 11″ with reference to the housing 1″, 3″ and shoulder 7″. The arrangement is preferably such that the member 30 can engage the third contact 36 only when it is disengaged from the element 33 of the first contact 5″ or vice versa.

Referring again to FIG. 3, the reference characters 16 denote therein two sidewalls or cheeks which form part of a printing machine and contain bearings for the cylinders 19. The second cylinder of the machine is located at a level above the illustrated cylinder 19.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An electric switch comprising a housing; a first contact in said housing; a second contact tiltably mounted in said housing, said second contact comprising a substantially disc-shaped member and said housing having a substantially cylindrical internal surface surrounding said member, said member having a convex peripheral surface adjacent said internal surface and said peripheral surface having a radius of curvature which equals or approximates the radius of said internal surface; deformable biasing means provided in said housing for urging said second contact against said first contact; and means for disengaging said second contact from said first contact with attendant deformation of said biasing means, including an abutment provided in said housing adjacent said disc-shaped member and means for tilting said second contact with reference to said abutment in any one of a plurality of different directions with attendant deformation of said biasing means to thereby disengage said second contact from said first contact, said tilting means being accessible externally of said housing and including a projection which is substantially coaxial with said member and extends from said member, said housing comprising guide means defining for said second contact a predetermined path along which said second contact is reciprocable with reference to said abutment by said biasing means or with attendant deformation of said biasing means into and out of engagement with said first contact.

2. The switch of claim 1, further comprising a third contact provided in said housing and engageable by said second contact in at least one tilted position of said second contact.

3. The switch of claim 1, further comprising means for actuating said tilting means including a displaceable barrier having a portion operatively connected with said tilting means and extending across a danger zone which is accessible in response to displacement of said barrier such as to cause said tilting means to disengage said second contact from said first contact.

4. The switch of claim 3, wherein said tilting means includes a bearing for said portion of said barrier.

5. The switch of claim 1, wherein said housing has an opening and said tilting means extends from said housing through said opening with freedom of swiveling movement with reference to said housing.

6. The switch of claim 1, wherein said second contact is disengaged from said abutment when acted on only by said biasing means.

7. The switch of claim 1, wherein said biasing means comprises an elastic washer, said second contact being disposed between said washer and said abutment.

8. The switch of claim 1, wherein said biasing means includes a conductor arranged to connect said second contact in circuit with an energy source.

9. An electric safety switch comprising a housing; a first contact in said housing; a second contact tiltably mounted in said housing and having a spherical peripheral surface; an abutment in said housing adjacent said second contact; deformable means for biasing said second contact against said first contact and toward said abutment; means for tilting said second contact with reference to said abutment with attendant deformation of said biasing means, including a portion extending from and being accessible outside of said housing to tilt said second contact in any one of a plurality of different directions and away from said first contact; and guide means for said second contact in said housing, said guide means having a cylindrical internal surface for the peripheral surface of said second contact, said peripheral surface having a radius of curvature closely approximating the radius of said internal surface so that the second contact is surrounded by said internal surface with a minimal play in the radial direction of said internal surface, said second contact being reciprocable along said internal surface by said biasing means or with attendant deformation of said biasing means into and from engagement with said first contact.

10. An electric switch comprising a housing; a first contact in said housing; a second contact tiltably mounted in said housing and comprising a substantially disc-shaped member; deformable biasing means provided in said housing for urging said second contact against said first contact; and means for disengaging said second contact from said first contact with attendant deformation of said biasing means, including an abutment provided in said housing adjacent said member and a conductor for tilting said second contact with reference to said abutment in any one of a plurality of different directions with attendant deformation of said biasing means to thereby disengage said second contact from said first contact, said conductor being accessible externally of said housing, being electrically connected with said member and including a projection which is substantially coaxial with said member and extends from said member in a direction away from said first contact.

11. An electric switch comprising a housing; a first contact in said housing; a second contact tiltably mounted in said housing; deformable biasing means provided in said housing for urging said second contact against said first contact; means for disengaging said second contact from said first contact with attendant deformation of said biasing means, including an abutment in said housing and means for tilting said second contact with reference to said abutment in any one of a plurality of different directions with attendant deformation of said biasing means to thereby disengage said second contact from said first contact, said tilting means being accessible externally of said housing; means for actuating said tilting means including a displaceable barrier having first and second portions, said first portion being operatively connected with said tilting means and extending across a danger zone which is accessible in response to displacement of said barrier such as to cause said tilting means to disengage said second contact from said first contact, said tilting means including a first bearing for said first portion; and a second bearing for said second portion of said barrier.

12. The switch of claim 11, further comprising a second housing, additional first and second contacts in said second housing and additional tilting means for said additional second contact, said additional tilting means including said second bearing.

13. An electric switch comprising a housing; a first contact in said housing; a second contact tiltably mounted in said housing, said second contact comprising a substantially disc-shaped member and said housing having a substantially cylindrical internal surface surrounding said member, said member having a convex peripheral surface adjacent said internal surface and said peripheral surface having a radius of curvature which equals or approximates the radius of said internal surface; deformable biasing means provided in said housing for urging said second contact against said first contact; and means for disengaging said second contact from said first contact with attendant deformation of said biasing means, including an abutment provided in said housing adjacent said disc-shaped member and means for tilting said second contact with reference to said abutment in any one of a plurality of different directions with attendant deformation of said biasing means to thereby disengage said second contact from said first contact, said tilting means being accessible externally of said housing and including a projection which is substantially coaxial with said member and extends from said member, said abutment at least partially surrounding said first contact.

14. An electric switch comprising a housing; a first contact in said housing; a second contact tiltably mounted in said housing, said second contact comprising a substantially disc-shaped member and said housing having a substantially cylindrical internal surface surrounding said member, said member having a convex peripheral surface adjacent said internal surface and said peripheral surface having a radius of curvature which equals or approximates the radius of said internal surface; deformable biasing means provided in said housing for urging said second contact against said first contact; and means for disengaging said second contact from said first contact with attendant deformation of said biasing means, including an abutment provided in said housing adjacent said disc-shaped member and means for tilting said second contact with reference to said abutment in any one of a plurality of different directions with attendant deformation of said biasing means to thereby disengage said second contact from said first contact, said tilting means being accessible externally of said housing and including a projection which is substantially coaxial with said member and extends from said member, said second contact having a side facing said abutment and being in engagement with said abutment at least in response to tilting of said second contact.

15. The switch of claim 14, wherein said abutment has a flat surface confronting said side of said second contact and said side has an annular zone which substantially concentrically surrounds said first contact, a portion of said annular zone being arranged to define with the adjacent portion of said abutment a fulcrum for said second contact in response to tilting of the second contact with reference to said abutment.

16. An electric switch comprising a housing; a first contact in said housing; a second contact tiltably mounted in said housing, said second contact comprising a substantially disc-shaped member and said housing having a substantially cylindrical internal surface surrounding said member, said member having a convex peripheral surface adjacent said internal surface and said peripheral surface having a radius of curvature which equals or approximates the radius of said internal surface; deformable biasing means provided in said housing for urging said second contact against said first contact; means for disengaging said second contact from said first contact with attendant deformation of said biasing means, including an abutment provided in said housing adjacent said disc-shaped member and means for tilting said second contact with reference to said abutment in any one of a plurality of different directions with attendant deformation of said biasing means to thereby disengage said second contact from said first contact, said tilting means being accessible externally of said housing and including a projection which is substantially coaxial with said member and extends from said member; and electric conductor means electrically connected with said second contact in each position of said second contact with reference to said first contact.

17. An electric switch comprising a housing; a first contact in said housing; a second contact tiltably mounted in said housing, said second contact comprising a substantially disc-shaped member and said housing having a substantially cylindrical internal surface surrounding said member, said member having a convex peripheral surface adjacent said internal surface and said peripheral surface having a radius of curvature which equals or approximates the radius of said internal surface; deformable biasing means provided in said housing for urging said second contact against said first contact; and means for disengaging said second contact from said first contact with attendant deformation of said biasing means, including an abutment provided in said housing adjacent said disc-shaped member and means for tilting said second contact with reference to said abutment in any one of a plurality of different directions with attendant deformation of said biasing means to thereby disengage said second contact from said first contact, said tilting means being accessible externally of said housing and including a projection which is substantially coaxial with said member and extends from said member, said second contact being in engagement with said abutment while in engagement with said first contact.

* * * * *